US005464275A

United States Patent [19]

Altemare et al.

[11] Patent Number: 5,464,275

[45] Date of Patent: Nov. 7, 1995

[54] END BRUSH AND METHOD OF MAKING

[75] Inventors: Robert L. Altemare, Parma; Joseph Sigal, South Euclid, both of Ohio

[73] Assignee: Jason, Inc., Cleveland, Ohio

[21] Appl. No.: 989,150

[22] Filed: Dec. 11, 1992

[51] Int. Cl.[6] ..... A46D 1/08

[52] U.S. Cl. ..... 300/21

[58] Field of Search ..... 300/21, 17; 15/180

[56] References Cited

U.S. PATENT DOCUMENTS

| | | | |
|---|---|---|---|
| 2,755,496 | 7/1956 | Benyar | 15/180 |
| 2,982,983 | 5/1961 | Peterson | 300/21 |
| 3,007,188 | 11/1961 | Dolan | 15/180 |
| 3,106,739 | 10/1963 | Less | 300/21 |
| 3,585,671 | 6/1971 | Schofield | 15/180 |

*Primary Examiner*—Timothy V. Eley
*Assistant Examiner*—John M. Husar
*Attorney, Agent, or Firm*—Renner, Otto, Boisselle & Sklar

[57] ABSTRACT

An end brush and a method of making the brush is disclosed using the automatic distribution and insertion of the bristle fill material into the cup of a cup-shape shank holder. A centered drive stem projects from the bottom of the holder. After a measured amount of the fill material is inserted through fill tubes and a guide funnel, a centering core insert is forced into the center of the cup to distribute the fill material around and against the interior wall of the cup. The material is cut to proper length and in the same or a separate station the exterior wall of the cup of the holder is deformed or crimped inwardly girdling the core securing and centering the core and material in the holder. Axial ribs are also formed which improves transfer of heat from the holder improving tool life. Preferably the insert is softer than the fill material and may also be softer than the holder. A wide variety of fill materials may be employed as well as various shapes of inserts and holders. The insert and holder may be piloted together during the assembly operation. The end brush is easier to make, has longer life, and has inherently better balance making the tool easier to use by hand or machine.

23 Claims, 3 Drawing Sheets

END BRUSH AND METHOD OF MAKING

This invention relates generally to an end brush and a method of making such brush. More particularly a simplified process of distributing, orienting and securing the bristle or filament fill material in an end brush design results in a tool with inherently better concentricity and balance. The process reduces manufacturing costs while reducing vibration resulting in better performance in both manual and automatic applications. Better balance in a manual operation results in less hand and operator fatigue.

BACKGROUND OF THE INVENTION

End brushes are often-manufactured utilizing rings, sleeves, pins or keys as anchors to secure the bristle fill material bundle in the holder with the fill material bundles being folded as a hairpin in the cup of the holder. This results in a non-uniform distribution and density of the fill material and also normally requires a secondary operation such as trimming of the brush face. Such internal anchors can in and of themselves affect the dynamic balance or stability of the tool quite apart from causing non-uniform distribution of the fill material.

Samples of end brushes or tools using mechanical anchors or keys may be seen in prior U.S. Pat. No. 2,982,983 to Peterson. Other examples are seen in Benyak U.S. Pat. Nos. 2,449,158 and 2,755,496, Less U.S. Pat. No. 3,106,739, Peterson U.S. Pat. No. 2,421,647 and Tilgner U.S. Pat. No. 3,237,234.

The brush making methods of these prior patents are such that it is difficult to distribute properly the fill material and also any insert or key such that good dynamic balance is obtained.

It is therefore desirable to have a method and end brush made by that method which will achieve good dynamic balance and which can be made quickly, automatically, and efficiently.

SUMMARY OF THE INVENTION

An end brush and a method of making the brush is disclosed using the automatic distribution and insertion of the bristle fill material into the cup of a cup-shape shank holder. A centered drive stem projects from the bottom of the holder. After a measured amount of the fill material is inserted through fill tubes and a guide funnel, a centering core insert is forced into the center of the cup to distribute the fill material around and against the interior wall of the cup. The material is cut to proper length and in the same or a separate station the exterior wall of the cup of the holder is deformed or crimped inwardly girdling the core securing and centering the core and material in the holder. Axial ribs are also formed which improves transfer of heat from the holder improving tool life. Preferably the insert is softer than the fill material and may also be softer than the holder. A wide variety of fill materials may be employed as well as various shapes of inserts and holders. The insert and holder may be piloted together during the assembly operation. The end brush is easier to make, has longer life, and has inherently better balance making the tool easier to use by hand or machine.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE PREFERRED EMBODIMENTS

Figure 2:
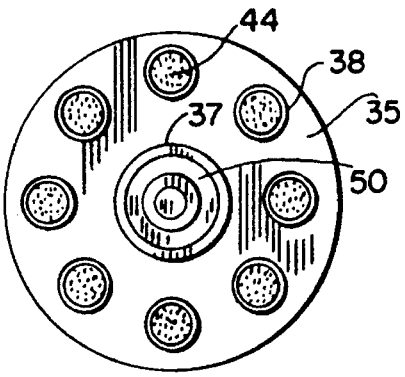
FIG. 2 is a horizontal section through the fill material tubes as seen from the line 2—2 of FIG. 1.

Referring initially to FIGS. 1–5 there is illustrated a press or jig which includes upper and lower portions 20 and 21 respectively. The movable or lower portion 21 includes a support 22 for cup holder 23.

The cup holder 23 includes a cylindrical wall 25, a bottom interior wall 26, and a concentric drive stem 27 projecting from the bottom of the holder. On top of the support 22 there is provided a funnel 29 which at its lower end overlies the rim 30 of the cup wall 25. The funnel is readily removed from the support 22 for insertion and removal of the cup holder. The tooling 22 and 29 may readily be replaced with similar tooling for different size or types of end brushes. As indicated by the arrow 32 the lower portion 21 is vertically movable toward and away from the upper portion 20.

The upper portion 20 includes two annular cut-off dies seen at 35 and 36 which are juxtaposed and mounted on sleeve 37. Extending vertically upwardly from the plate 35 are fill tubes 38, which, as shown in FIG. 2, are eight in number and equally spaced around the vertical axis of the jig. The fill tubes 38 are mounted above slightly inwardly angled holes 40 in plate 35 and as seen, plate 36 includes slightly more angled holes 42 forming a continuation of the holes 40. It is also noted that the diameter of the slightly more angled holes 42 is slightly larger than the diameter of the holes 40 in the plate 35. It is also noted that the maximum circle formed by the holes 42 in the bottom of the plate 36 is slightly smaller than the maximum diameter of the upper edge of the funnel 29.

Figure 1:
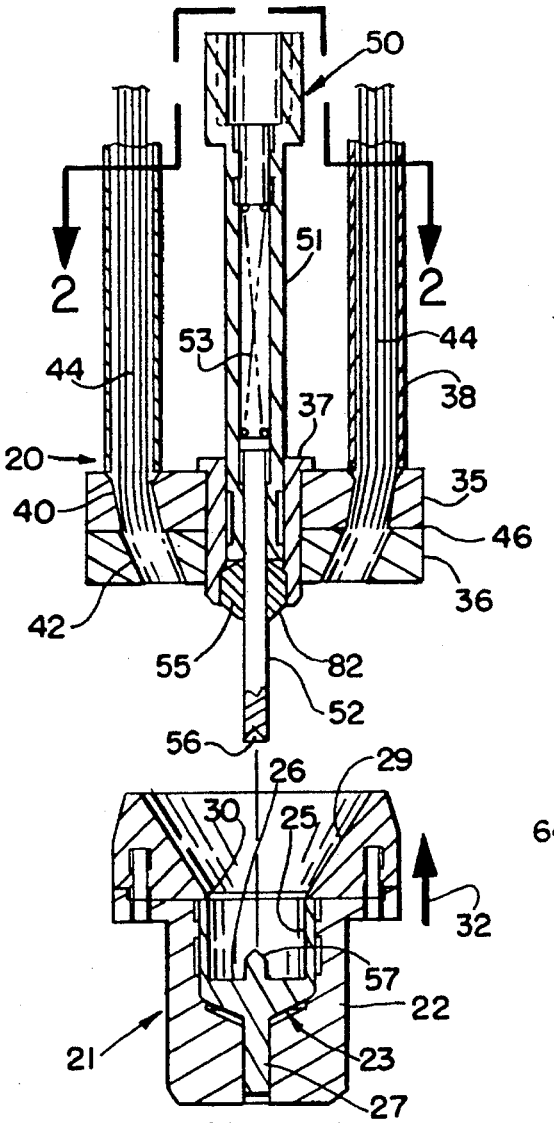
FIG. 1 is a vertical section of apparatus with the parts in place and prior to closing for making a brush according to the process of the present invention.

Situated within each fill tube is an equal measured amount of fill material indicated at 44. As illustrated in FIG. 1, the fill material projects through the tubes and through the holes 40 to the line 46 which is the cut-off line between the two annular cut-off dies. It will be appreciated that more or fewer fill tubes may be provided depending upon the size of the brush being formed. The purpose of the equally circumferentially spaced fill tubes and corresponding holes is to assist in achieving proper fill distribution.

In the center of the upper portion of the jig there is provided a core or insert pusher indicated generally at 50. The pusher 50 comprises a vertically movable plunger 51 mounted in sleeve 37 for vertical movement. The insert pusher includes a downwardly projecting guide pin 52 which is urged to its extended position by compression spring 53. The guide pin 52 extends through insert 55 which is seated in the recess shown in the lower end of sleeve 37. The tip of the pin 52 is provided with a conical recess indicated at 56 which mates with a conical projection on pilot stud 57 projecting from the bottom wall 26 of cup holder 23. The cup holder 23 and the insert 55 may be loaded manually or automatically into the equipment illustrated.

Figure 3:
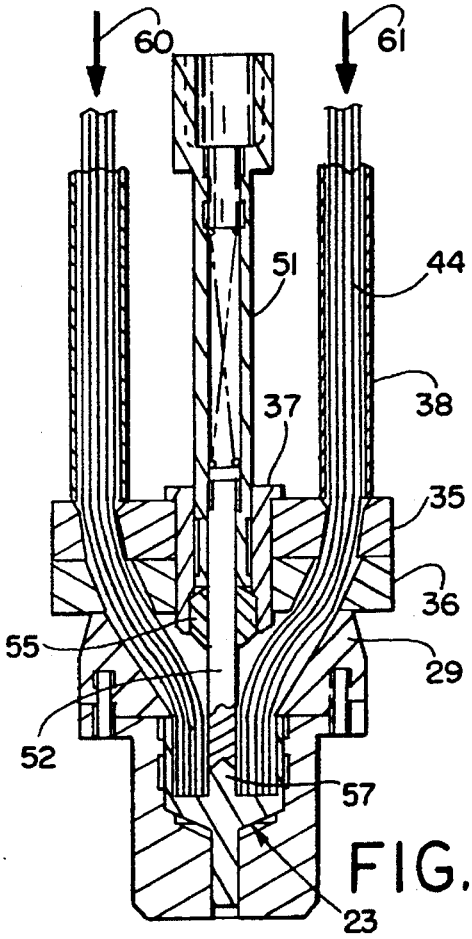
FIG. 3 is a view similar to FIG. 1 but with the parts closed and fill material in place.

Referring now to FIG. 3 with the cup holder elevated the fill material 44 is fed through the series of guide tubes 38 to the guide funnel 29 and then into the holder 23 as indicated by the arrows 60 and 61. In this manner the fill material is positioned symmetrically, around the holder to achieve substantially proper distribution. In such position the guide pin 52 and pilot 57 are in engagement with each other.

Figure 4:
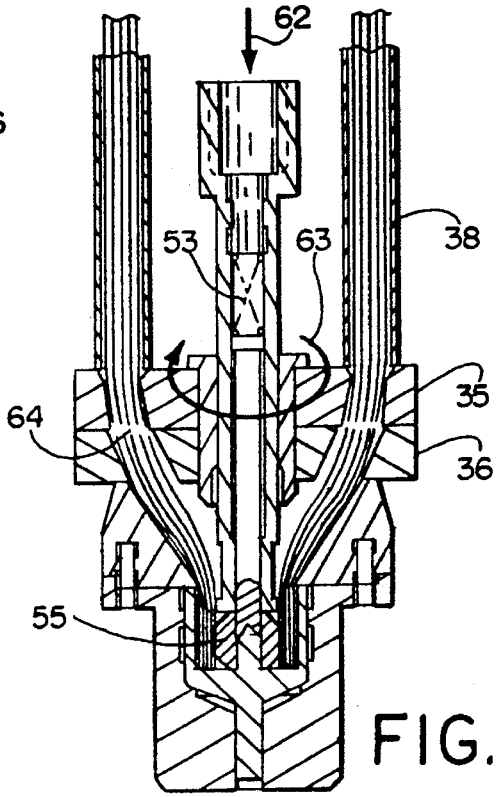
FIG. 4 is a view similar to FIG. 3 showing the insert in place and the fill material being cut.

As seen in FIG. 4, the insert pusher 50 is now actuated to feed the insert 55 into the holder as indicated by the arrow 62. This wedging of the insert into place applies a slight pressure on the fill material which will cause the fill material to be evenly distributed in the holder. The downward movement of the pusher compresses spring 53 and slides the insert down the guide pin 52 and telescopes the insert over the pilot stud 57. With the fill material and insert secured, the fill material is cut to the proper length as indicated in FIG. 4 by rotation of the plate 35 as seen by arrow 63 severing the fill material at 64.

Figure 5:
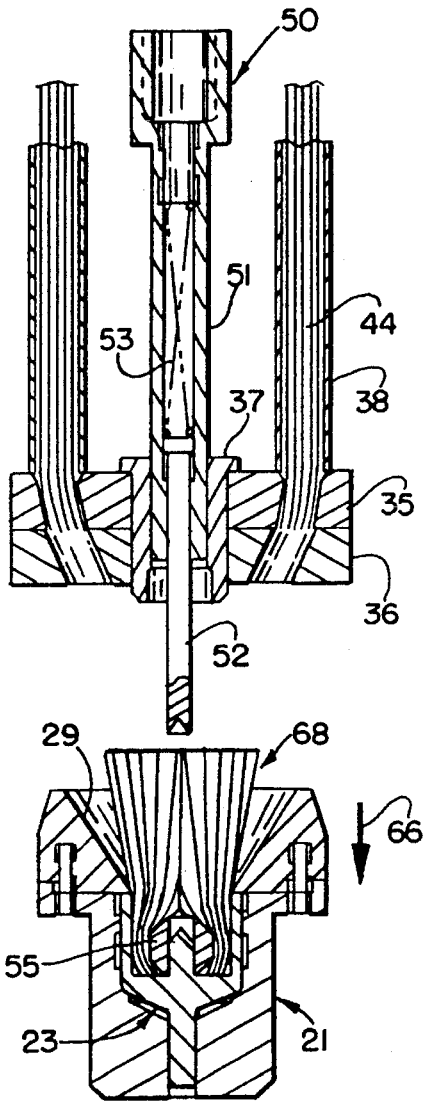
FIG. 5 is a view similar to FIG. 1 with the parts separating.
Figure 6:
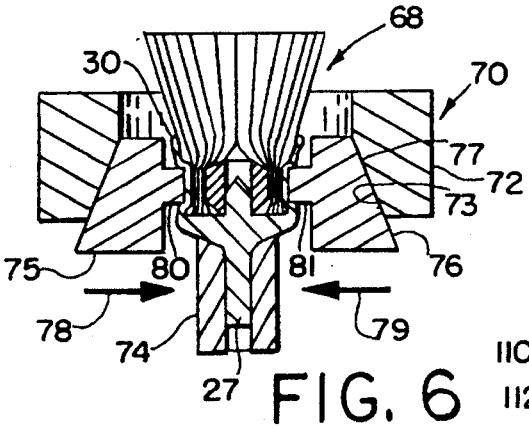
FIG. 6 is a view illustrating the step of deforming the cup wall against the waist of the insert.

As seen in FIG. 5 the equipment opens as indicated by the arrow 66 and returns to the position seen in FIG. 1. The end brush thus formed shown generally at 68 is manually or automatically removed and is loaded into secondary swaging press seen in FIG. 6 and shown generally at 70. The swaging apparatus or press comprises an annular ring 72 which includes an internal wedge surface 73. The swaging equipment may also include a brush support indicated generally at 74 which receives the drive stem 27 holding the brush concentrically with respect to the axis of the cone of wedge surface 73. A series of circularly arranged swaging dies indicated at 75 and 76 have external conical wedge surfaces 77 mating with the surface 73. As the ring 72 moves axially, the swaging dies shown at 75 and 76 close as indicated by the arrows 78 and 79 causing the inward projections seen at 80 and 81 to engage and deform inwardly the circular wall of the cup.

It is noted that the insert 55 is beveled both top and bottom, the lower bevel being seen more clearly at 82 in FIG. 1. Between such beveled ends the insert is provided with a right circular cylindrical exterior surface. The swaging or crimping dies act opposite that surface to provide a girdling swage which is effective to lock uniformly the fill material into the cup holder and uniformly distribute it around the axis of the tool. In this manner the girdling deformation of the cup wall is spaced axially both from the rim 30 of the cup as well as from the bottom wall 26, and the inward extent of deformation is symmetrical and centered with respect to the axis of the cup.

Figure 11:
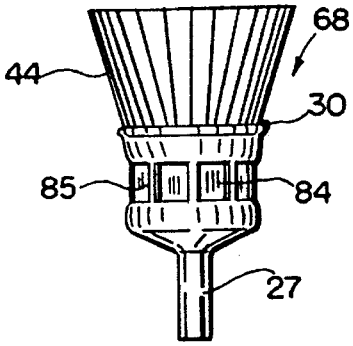
FIG. 11 is a side elevation of another form of insert girdling deformation, such brush being shown in section in FIG. 5, for example.

The completed assembly is then unloaded manually or automatically from the press and the completed tool is shown in FIG. 11. As illustrated in FIG. 11 there are eight different crimping dies in the swaging press which form recessed panels indicated at 84 which are separated by axially extending ribs 85. Thus in the closed position the dies don't form a complete circle and the metal of the cup holder cold flows between the dies to form such axial ribs.

It has been found that a ribbed surface on the exterior of the holder will generate the movement of air which will improve the transfer of heat from the holder to the surrounding air. The reduction of heat build-up in the holder subsequently reduces the heat in the fill material which improves the life of the fill material and of course the life of the tool. It is also important that the girdling swage of the cup wall be spaced from the cup rim indicated at 30 in FIG. 11 so that the filaments or fill material are supported through a gradual flare of the brush face and are not pinched or constricted where they exit the holder.

Figure 7:
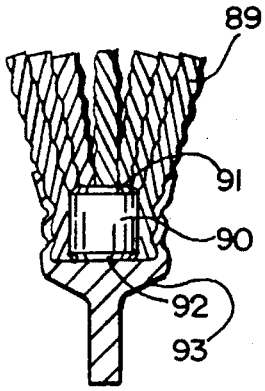
FIG. 7 is a vertical section of an end brush in accordance with the present invention using twisted wire or cable as the fill and with a more cylindrical insert.
Figure 8:
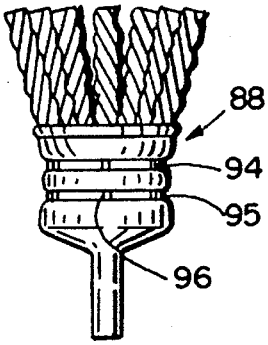
FIG. 8 is an elevation of the brush of FIG. 7 illustrating one form of girdling deformation.

Referring now to FIGS. 7 and 8 there is illustrated a brush embodiment shown generally at 88 which utilizes twisted wire or cable as the fill material shown generally at 89. Each twisted wire or cable may be inserted through a single fill tube. The brush 88 also utilizes a somewhat more cylindrical insert 90 which is beveled top and bottom as indicated at 91 and 92. The cup wall of cup holder 93 is provided with two axially spaced girdling deformations seen at 94 and 95, both being provided with axial ribs 96.

Figure 9:
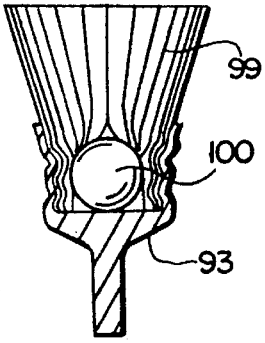
FIG. 9 is a view similar to FIG. 7 illustrating a brush with a metallic or non-metallic fill material and with a ball insert.
Figure 10:
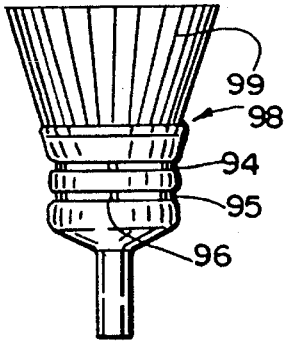
FIG. 10 is an elevation of the brush of FIG. 9.

In FIGS. 9 and 10 there is illustrated another type of end brush 98 using the same type of cup holder 93 with the horizontal axially spaced deformation bands 94 and 95 again having vertical ribs 96. The fill material 98 may be metallic or non-metallic material. However, the insert as illustrated 100 is in the form of a ball.

Figure 12:
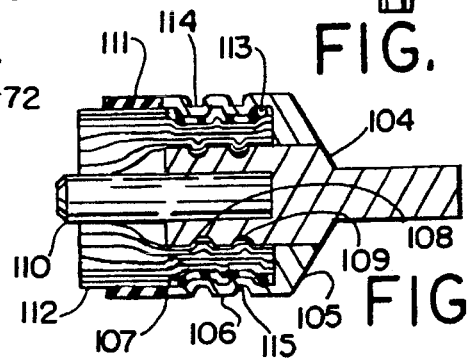
FIG. 12 is an axial section of a form of the invention using a two-piece shank or cup, an insert pilot, an exterior bridle, and an inside sleeve.

Other modifications of and options usable with the present invention are illustrated in FIGS. 12–18. Referring initially to FIG. 12, it will be seen that the cup holder is formed of two parts which may be termed a shank 104 and a cup body 105. The cup body includes a cylindrical cup wall 106 which terminates in rim 107. The shank projects inwardly of the cup body and includes a pair of radially facing grooves 108 and 109. Mounted in the shank is an axially projecting pilot 110. Such pilots are commonly employed when the end brush is used to spot face a surface around a hole. The pilot simply projects into the hole. The brush of FIG. 12 also includes an annular elastic bridle 111 surrounding fill material 112 as well as an internal resilient sleeve 113. The exterior of the cup wall is deformed inwardly as seen at 114 and 115 in a manner similar to that seen in FIG. 8 and 10.

Figure 13:
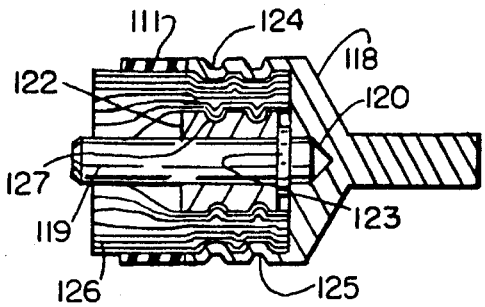
FIG. 13 illustrates in a similar manner a one-piece cup or shank with an insert on a pilot.

The tool of FIG. 13 is formed with a one-piece cup holder 118 which includes a projecting pilot 119 inserted in recess 120 located in the center of the internal bottom wall of the cup. A grooved insert 122 is mounted on the pilot 119 against flange 123 of the pilot which slightly spaces the insert 122 from the bottom of the cup. The tool is also provided with bridle 111 and the axially spaced girdling deformations 124 and 125 locking the fill material 126 in place. The insert 122 also has axially spaced radially outwardly facing grooves as seen at 127. The number and type of grooves are optional. Pilot 119 and insert 122 may be one piece.

Figure 14:
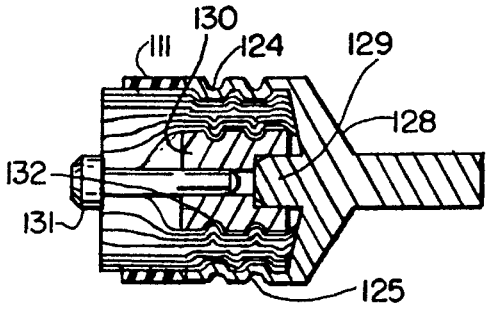
FIG. 14 illustrates a tool with a headed pilot option.

The tool of FIG. 14 also includes a one-piece cup holder 128 which includes a male projecting pilot 129 from the center of the bottom wall of the cup on which the insert 130 is positioned. The insert includes a relatively smaller through-hole into which is positioned headed pilot 131. The tool of FIG. 14 also includes a bridle 111 and the external deformations 124 and 125 locking the fill material 126 in place. The insert also has external grooves 132.

Figure 15:
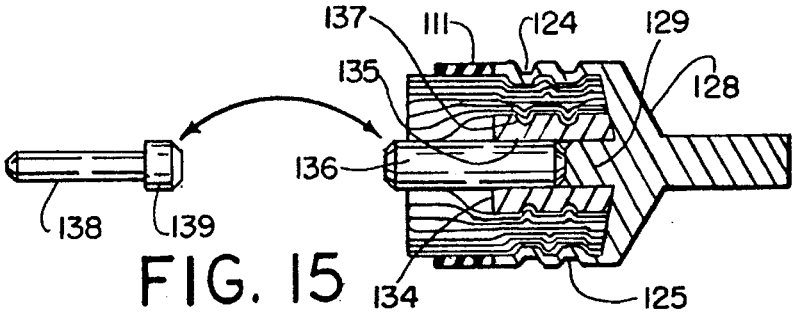
FIG. 15 illustrates a one-piece shank or cup and an insert with two different types of pilots.

FIG. 15 illustrates a tool formed with the same one-piece cup holder 128 but utilizing an insert 134 having a somewhat larger diameter through-hole 135 into which fit both the male pilot projection 129 and pilot pin 136. The insert also has external grooves seen at 137. As illustrated, the pilot pin 136 may be replaced by pilot pin 138 which has a head 139 of the same diameter as the pin 136.

Figure 16:
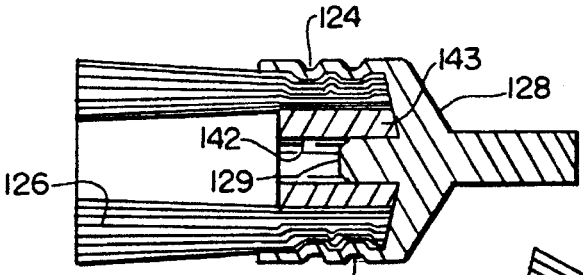
FIG. 16 illustrates a standard piloted hollow insert.

FIG. 16 illustrates a brush similar to that shown in FIG. 15 but without the pilot pin and utilizing simply a hollow center in the insert as indicated at 142. The hollow center 142 of the insert 143 fits over the male projection 129 and the girdling inward deformations 124 and 125 again lock the fill material in place. The insert may or may not include the exterior grooves. FIG. 16 thus illustrates a standard hollow center brush.

Figure 17:
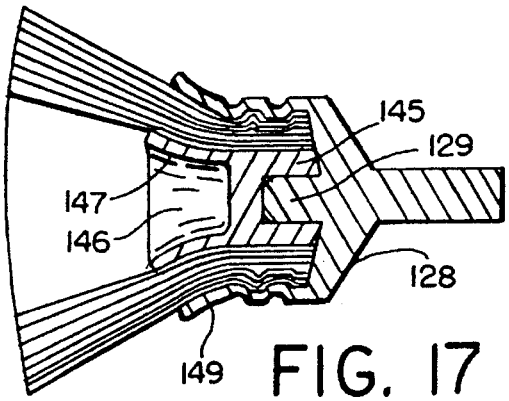
FIG. 17 illustrates a hollow center type brush with both the insert and the cup wall somewhat flared.

FIG. 17 illustrates essentially the same brush but with a slightly different hollow insert. The insert 145 of FIG. 17 is fitted on the male pilot 129 of the cup shank 128 but includes a hollow center 146 with a relatively thin peripheral wall 147. Both the cup wall indicated at 149 and the wall 147 are flared to provide a flared hollow center type brush.

Figure 18:
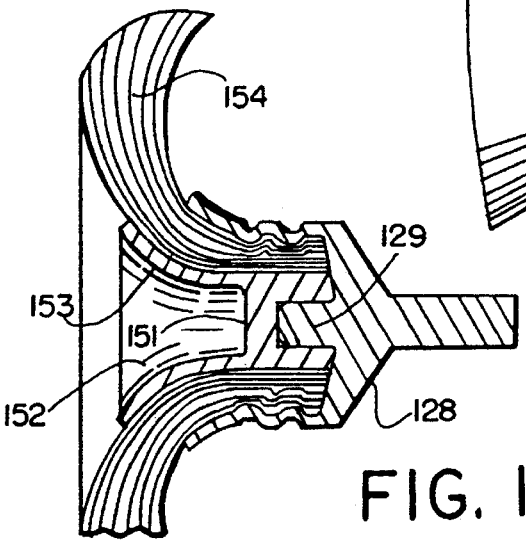
FIG. 18 illustrates in essence the same brush with both parts more severely flared to form a circular end brush.

FIG. 18 illustrates essentially the same brush but with a somewhat different insert 151 having a hollow center 152 with somewhat longer flared walls 153. Again the exterior wall of the cup indicated at 149 is also flared. The flaring indicated provides in essence a circular end brush with the flaring directing the fill material 154 essentially radially of the cup holder.

In all embodiments, the location of the insert and the deformation with respect to the holder results in a reduction of stress to the fill material. The filaments are supported through a gradual flare of the brush face. The deformation provides uniform pressure across a wide area of the fill material.

Proper positioning of the insert with or without the use of a pilot will result in the proper distribution of the fill material and the proper distribution results in better balance and reduced vibration. This in turn results in better performance for the tool and longer life due to the reduction of vibration. The reduction of vibration is also better suited for hand held applications.

A somewhat soft material is preferred for the insert such as a malleable metal such as brass, or even a plastic. It is preferred that the insert be softer than steel and softer than the holder and softer than the fill material. This permits the insert to conform to the shape of the filaments and results in better distribution and locking of the filaments in place.

As far as the holder is concerned the outer and inner configurations of the cup holder may vary in size and shape and be of metallic or non-metallic materials. As illustrated the insert may be an integral part of the holder or the holder may include a pilot or the mating geometry for a pilot to help in positioning the insert. If a plastic holder is employed, the swaging or crimping dies may be heated to provide a permanent set to the plastic body.

The fill material may include a wide variety of filaments such as wires, cables, non-metallic filaments, abrasive filled or coated metallic or non-metallic filaments, and natural fibers.

Although a swaging or crimping operation has been illustrated, the deformation of the cup wall may be accomplished by a variety of operations such as swaging, crimping, clamping, compression, upsetting, rolling with horizontal, vertical or cylindrical impressed surface areas.

The process provides a low cost tool which may be made with a high degree of automation and shorter cycle times and also the elimination of trim loss. The better balanced tool utilizes the positive positioning of the insert to keep the filaments aligned and evenly distributed and the girdling deformation of the cup wall away from the cup rim results in improved tool life.

Although the invention has been shown and described with respect to preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A method of making a cup brush comprising the steps of supporting a cup holder having a bottom and a circular wall terminating in a rim, forming and driving a hollow cylindrical bundle of fill material to the bottom of the cup, distributing the bundle uniformly against the cup wall and symmetrically around a center core with substantially all of the tips of the fill material engaging the cup holder bottom, and deforming the cup wall inwardly against the uniform symmetrical bundle and directly against the core to lock the fill material in place between the deformed cup wall and core about the axis of the cup.

2. A method as set forth in claim 1 wherein said core is part of the cup holder and said bundle is driven around said core.

3. A method as set forth in claim 1 wherein said step of deforming the cup wall is at a location spaced away from said rim whereby the fill material bundle is not constricted as it exits the cup holder.

4. A method as set forth in claim 1 wherein said deforming step also forms axial ribs on the exterior of the cup circular wall to improve the transfer of heat from the cup holder.

5. A method as set forth in claim 1 wherein said deforming of the cup wall inwardly girdles the core and wall providing uniform pressure on the bundle within the cup across a substantial area.

6. A method as set forth in claim 1 wherein said inward deformation against the core is at at least two axially spaced locations.

7. A method as set forth in claim 1 wherein said core is circular in transaxial section.

8. A method as set forth in claim 1 wherein said core is softer than the fill material of the bundle.

9. A method as set forth in claim 8 wherein said insert interfits with the cup to maintain the insert centered in the cup.

10. A method as set forth in claim 1 including the step of aligning the extent of inward deformation to be symmetrical about the axis of the cup.

11. A method as set forth in claim 1 wherein said bundle of fill material is continuous, and including the step of cutting said fill material to a trim length before deforming said wall.

12. A method of making a cup brush comprising the steps of supporting a cup, having a bottom and a circular wall terminating in a rim, and a drive axis, providing a plurality of continuous bundles of fill material, and arranging such bundles circularly around and parallel to the axis of the cup, driving said bundles to the bottom of the cup, distributing the fill material between a central circular core and the interior Of the wall of the cup with substantially all of the tips of the fill material engaging the cup holder bottom, and then deforming the circular wall of the cup inwardly opposite the core further to distribute and grip the fill material between the cup wall and core.

13. A method as set forth in claim 12 including the step of aligning the extent of inward deformation to be symmetrical about the drive axis of the cup.

14. A method as set forth in claim 13 including the step of interfitting the insert with the cup to maintain the insert centered in the cup.

15. A method as set forth in claim 14 wherein said deforming step is located axially spaced from the rim of the circular wall.

16. A method as set forth in claim 15 including the step of forming axial ribs in said cup wall to facilitate air cooling of the brush.

17. A method as set forth in claim 16 wherein said insert is softer than the filaments of the bundle.

18. A method as set forth in claim 17 wherein said deforming of the cup wall girdles the insert and wall providing uniform pressure on the bundles across a substantial area.

19. A method as set forth in claim 18 wherein said inward deformation against the core is at at least two axially spaced locations.

20. A method of making a cup brush comprising the steps of supporting a cup holder having a bottom and a circular wall terminating in a rim, forming and driving a hollow cylindrical bundle of fill material to the bottom of the cup, distributing the bundle uniformly against the cup wall and symmetrically around a center core, and deforming the cup wall inwardly against the uniform symmetrical bundle and directly against the core to lock the fill material in place between the deformed cup wall and core about the axis of the cup, said core comprising an insert inserted into the cup after the insertion of the bundle.

21. A method of making a cup brush comprising the steps of supporting a cup holder having a bottom and a circular wall terminating in a rim, forming and driving a hollow cylindrical bundle of fill material to the bottom of the cup, distributing the bundle uniformly against the cup wall and symmetrically around a center core, and deforming the cup wall inwardly against the uniform symmetrical bundle and directly against the core to lock the fill material in place between the deformed cup wall and core about the axis of the cup, said core being provided with annular grooves radially opposite the deformations.

22. A method of making a cup brush comprising the steps of supporting a cup, having a bottom and a circular wall terminating in a rim, and a drive axis, providing a plurality of continuous bundles of fill material, and arranging such bundles circularly around and parallel to the axis of the cup, driving said bundles to the bottom of the cup, distributing the fill material between a central circular core and the interior of the wall of the cup, and then deforming the circular wall of the cup inwardly opposite the core further to distribute and grip the fill material between the cup wall and core, said core comprising an insert inserted axially into the center of the cup after insertion of the bundles.

23. A method as set forth in claim 22 including cutting said fill material to a trim length after insertion of the insert but before the deformation of said wall.

* * * * *